United States Patent [19]

Andersson et al.

[11] 4,019,675

[45] Apr. 26, 1977

[54] LOCKING CONTAINER

[75] Inventors: Rolf Andersson, Lund; Bengt Björklund, Kavlinge; Tommy Hedberg, Lund, all of Sweden

[73] Assignee: AB Akerlund & Rausing, Lund, Sweden

[22] Filed: Oct. 21, 1975

[21] Appl. No.: 624,411

[30] Foreign Application Priority Data

Nov. 8, 1974 Sweden ..... 7414033

[52] U.S. Cl. ..... 229/31 R; 229/43

[51] Int. Cl.[2] ..... B65D 5/24; B65D 5/12

[58] Field of Search ..... 229/30, 31 R, 7 R, 43

[56] References Cited

UNITED STATES PATENTS

| | | | |
|---|---|---|---|
| 3,018,024 | 1/1962 | Foord | 229/7 R |
| 3,021,001 | 2/1962 | Donofrio | 229/43 X |
| 3,055,540 | 9/1962 | Ringlen | 229/43 X |
| 3,536,248 | 10/1970 | Odenhagen et al. | 229/31 R |
| 3,550,835 | 12/1970 | Persson | 229/31 R |
| 3,900,155 | 8/1975 | Rausing | 229/7 R |
| 3,917,155 | 11/1975 | Bemiss | 229/30 X |

*Primary Examiner*—Davis T. Moorhead

*Attorney, Agent, or Firm*—Lerner, David, Littenberg & Samuel

[57] ABSTRACT

A locking container is disclosed which comprises a bottom wall and at least one wall projecting upwardly from the bottom wall so as to define a cavity. The container further includes a flange projecting outwardly from the wall and provided with reinforcing means secured thereto which extend inwardly from the wall into the cavity. The reinforcing means are adapted to receive and lock in place a cover member in sealing relationship to the container.

8 Claims, 14 Drawing Figures

LOCKING CONTAINER

SUMMARY OF THE INVENTION

The present invention relates to a trough-shaped package, comprising a bottom, side walls projecting from the bottom and and edge flange projecting from the side walls. Preferably, the package is designed to be used for edible fat or the like, and therefore below the invention will be described with reference to such a use. However, to a person skilled in the art it is obvious that the package of course also may be used for many other products.

The package according to the invention is characterized in that said edge flange wholly or partially is reinforced by glued or otherwise attached frame portions adapted by means of portions extending inwardly over the package mouth to firmly keep in place a cover extending into the package mouth. Preferably, said frame portions are made of a fat-repellent material, such as polyvinyl-chloride or polypropene. Alternatively the frame portions like the rest of the package may be manufactured from cardboard which in itself contains a fat-repellent material or is provided with section edges prepared with such a fat-repellent material, such as a chrome-complex sold under the trade name SCOTCH BAN.

Said frame portions may consist of a an entirely closed frame, the outer dimensions of which principally correspond to those of the edge flange. Said entirely closed frame may be manufactured either separately or in one piece with the rest of the package blank. A separately maufactured frame of course has the advantage that the material may be selected independently of the rest of the package.

In a package having a rectangular mouth said frame portions may be in accordance with the longitudinal portions of the edge flange and at the same time extend only a short distance over the transverse portions of the edge flange. In this case they may be two in number, and each of them may be made up in one piece with that longitudinal portion of the edge flange to which they should be connected. By this means a material-saving structure is achieved.

The locking action between the cover extending into the the package and the frame portions preferably takes place at the corners of the package mouth in that here said frame portions have a larger radius than the rest of the package itself so as to span the mouth in these corners and to provide here a locking action on the sliding cover which accordingly is provided with a somewhat longer diagonal than the diagonal distance between frame portions, defining two corners.

DESCRIPTION OF THE DRAWINGS

Below the invention is more exactly described with reference to the accompanying drawings which by means of examples illustrate three alternative embodiments of the invention.

DETAILED DESCRIPTION

Figure 1:
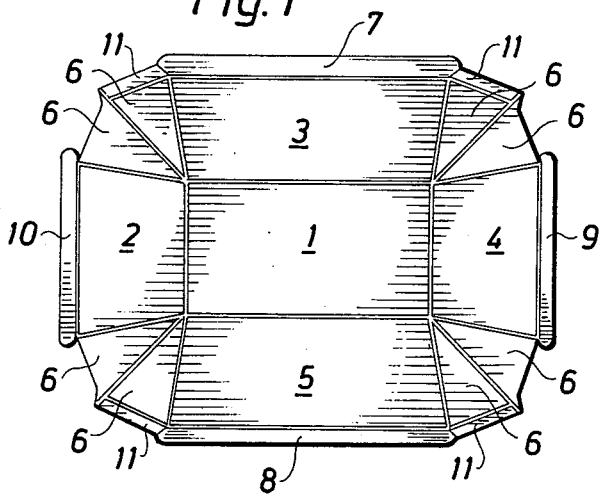
FIG. 1 shows a cardboard blank for a first embodiment of the invention.

FIG. 1 shows a cardboard blank for a first embodiment of the invention. The blank consists of a bottom panel 1, side wall panels 2, 3, 4, 5, corner wall panels 6 and edge flange panels 7, 8, 9, 10 and 11. The edge flange panels 11 are four in number. Since the package primarily is intended for edible fat and the like it is coated on the inside with polypropene and on the outside with polyethylene. However, also other coatings may be used.

Figure 2:
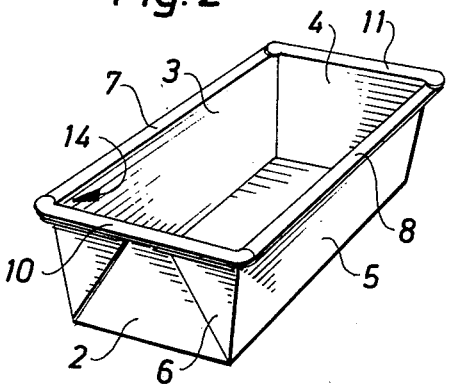
FIG. 2 shows the package blank according to FIG. 1 in the raised condition thereof.
Figure 3:
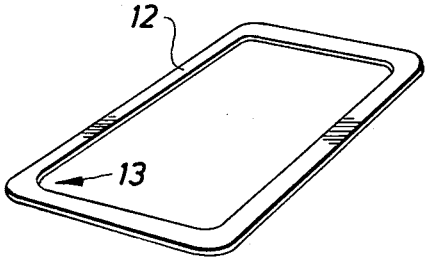
FIG. 3 shows a frame adapted to be attached to the package according to FIG. 2.
Figure 4:
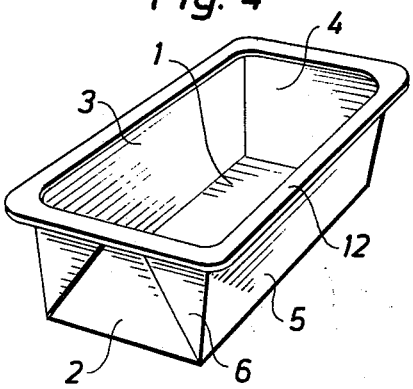
FIG. 4 shows the appearance of the package after mounting of the frame according to FIG. 3.
Figure 5:
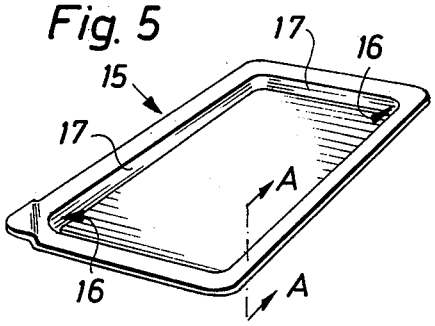
FIG. 5 shows a cover adapted to snap into the package according to FIG. 4.
Figure 5A:
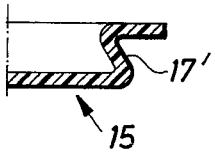
FIG. 5A is a section on line A — A of FIG. 5.
Figure 6:
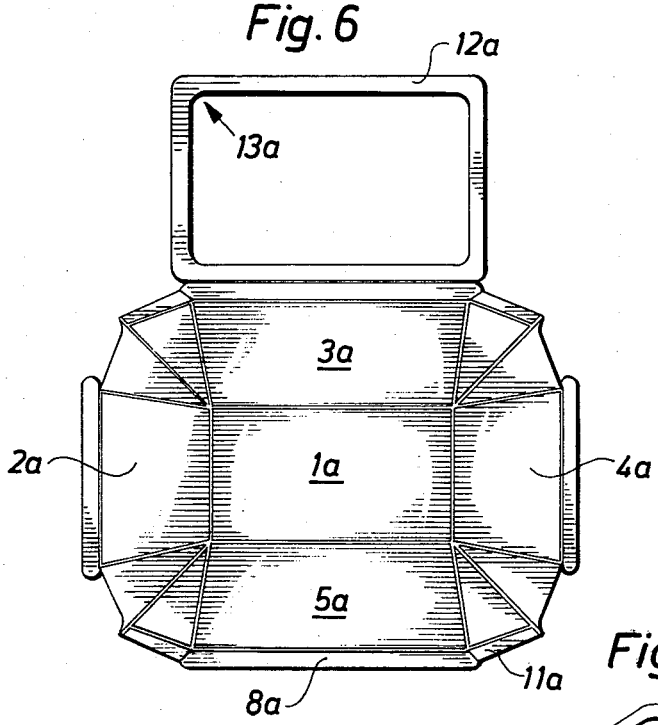
FIG. 6 shows the blank for a second embodiment of the invention.
Figure 9:
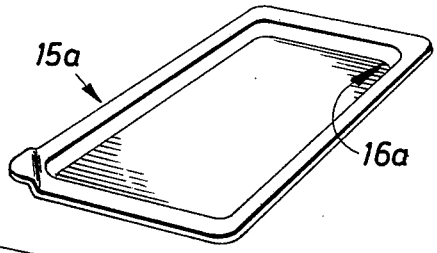
FIG. 9 shows a cover adapted to snap into the package according to FIG. 8.
Figure 7:
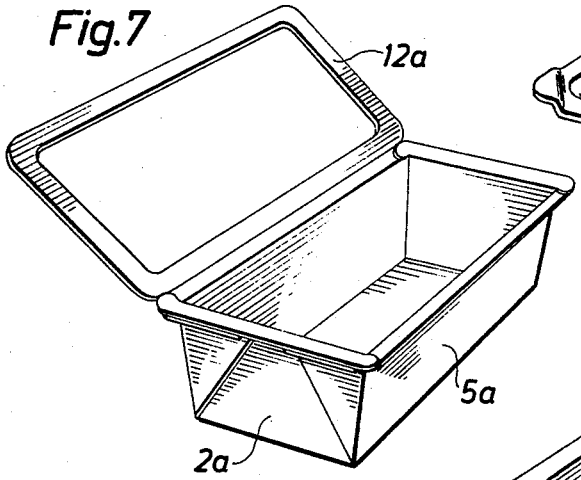
FIGS. 7 and 8 show the blank according to FIG. 6 in a partially and entirely raised condition thereof, respectively.
Figure 8:
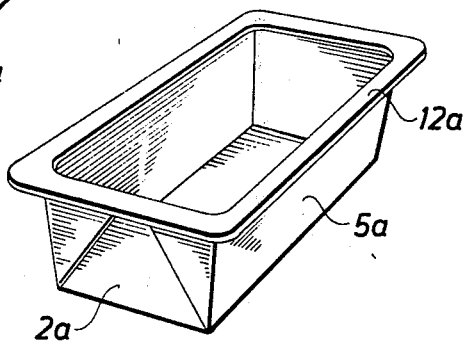
Figure 10:
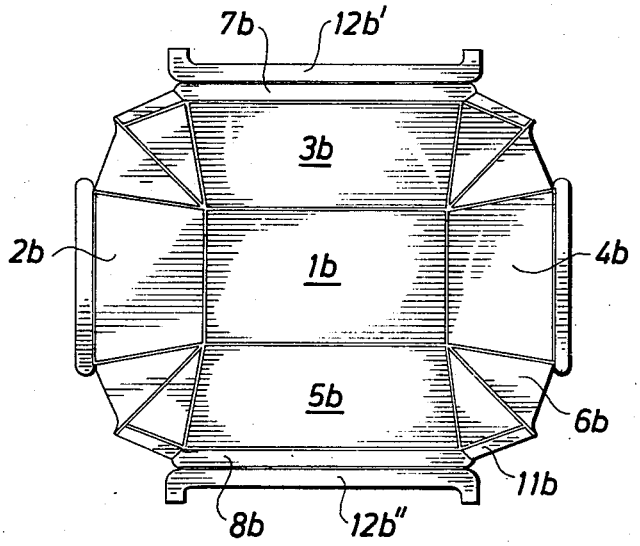
FIG. 10 shows the blank for a third embodiment of the invention.
Figure 11:
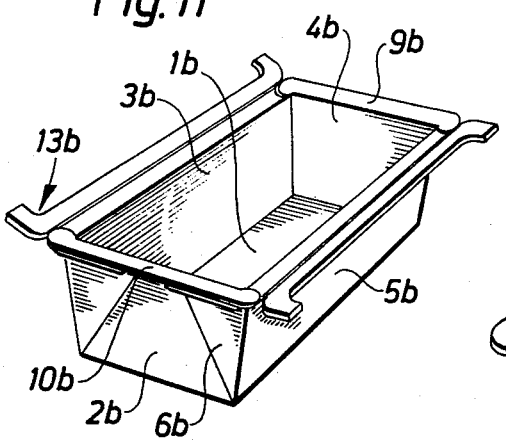
FIGS. 11 and 12 show the blank according to FIG. 10 in a partially and entirely raised condition thereof, respectively.
Figure 12:
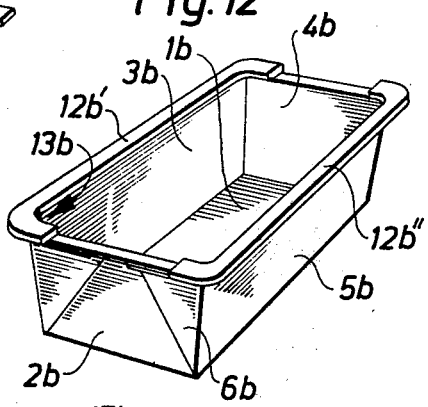
Figure 13:
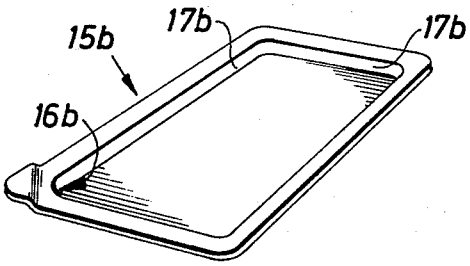
FIG. 13 shows a cover adapted to snap into the package according to FIG. 12.

The blank according to FIG. 1 in conventional way is raised into the shape shown in FIG. 2, after which the frame 12 shown in FIG. 3 is attached to the edge flange so as to provide the package shown in FIG. 4. It should be noted that the frame 12 in the corners 13 has a somewhat larger radius of curvature than the underlying portion of the package in the corners 14. The corners 14 of the package mouth therefore will be spanned by the frame 12. This is utilized to secure a cover 15 (FIG. 5) which at the corners 16 thereof has a negative inclination of the normally essentially vertical portions 17. Compare FIG. 5A in which said portion has reference numeral 17'.

In FIGS. 6–9 a second embodiment of the invention is shown. This embodiment is principally in accordance with the embodiment of FIGS. 1–5, apart from the fact that the frame is manufactured in one piece with the rest of the package blank. Therefore a more exact specification is not necessary. Moreover, the drawings are provided with the same reference numerals as FIGS. 1–5, with addition of small letter *a* . For the sake of clearness, however, all of the reference numerals have not been put down.

FIGS. 10–13 show a third embodiment of the invention. Also this embodiment principally is in accordance with the two embodiments described above, and therefore also in this case the same reference numerals are used, with addition of small letter *b*. The difference consists in that in this embodiment not a completely unbroken frame is used but two frame portions **12*b'* and 12*b''*, respectively, made up in one piece with the edge flange portions 7*b* and 8*b***, respectively. In other respects the structure is in accordance with the structures described above.

The invention of course is not restricted merely to the embodiments described above but may be varied within the scope of the following claims. Thus, for instance, the materials of the different portions of the package may be varied dependent on the product to be packed and the invention principle of course may be applied to troughs having other corner folding than that one described above. Also other modifications are possible within the scope of the invention conception.

We claim:

1. A container comprising a bottom wall, at least one wall projecting upwardly from said bottom wall to define a cavity, said at least one wall comprising at least two oppositely disposed side portions, a flange projecting outwardly from said wall, said flange having reinforcing means secured thereto at said side portions, a cover member comprising an outer edge flange integral with an inner countersunk portion disposed in a different plane than said outer edge flange and connected thereto by a substantially vertical portion, said reinforcing means being so constructed that it extends inwardly from said wall into said cavity to receive and lock in place said cover member in sealing relationship to said container, and said countersunk portion and said substantially vertical portion cooperating with said reinforcing means to lock said cover member in sealing relationship to said container.

2. The container of claim 1, wherein said reinforcing means is integral with said flange at at least one of said side portions.

3. The container of claim 1, wherein there are four walls projecting upwardly from said bottom wall arranged in such a manner that they define a rectangular cross-section.

4. The container of claim 3, wherein said flange extends around the entire perimeter of said container.

5. The container of claim 4, wherein said reinforcing means extend around the entire length of said flange.

6. The container of claim 3, wherein said reinforcing means comprises two side members secured to said flange and said side portions and said members extend around the corners of said container.

7. The container of claim 1 wherein said flange is integral with and folded along the upper edge of said wall.

8. The container of claim 3 wherein said flange is integral with and folded along the upper edges of said walls.

* * * * *